US010267581B2

(12) United States Patent
Hangen

(10) Patent No.: US 10,267,581 B2
(45) Date of Patent: Apr. 23, 2019

(54) FIREARM CONFIGURATION FOR REDUCING RECOIL

(71) Applicant: 5794 Corporation, Winter Garden, FL (US)

(72) Inventor: William A. Hangen, Winter Garden, FL (US)

(73) Assignee: 5794 Corporation, Winter Garden, FL (US)

( * ) Notice: Subject to any disclaimer, the term of this patent is extended or adjusted under 35 U.S.C. 154(b) by 0 days.

(21) Appl. No.: 16/130,044

(22) Filed: Sep. 13, 2018

(65) Prior Publication Data

US 2019/0011203 A1 Jan. 10, 2019

Related U.S. Application Data

(63) Continuation-in-part of application No. 15/988,165, filed on May 24, 2018, which is a continuation-in-part of application No. 15/485,626, filed on Apr. 12, 2017, which is a continuation-in-part of application No. 15/095,415, filed on Apr. 11, 2016, now Pat. No.
(Continued)

(51) Int. Cl.

| | |
|---|---|
| ***F41A 21/00*** | (2006.01) |
| ***F41A 3/86*** | (2006.01) |
| ***F41A 19/10*** | (2006.01) |
| ***F41A 9/64*** | (2006.01) |
| ***F41A 25/12*** | (2006.01) |

(Continued)

(52) U.S. Cl.

CPC ..... *F41A 3/86* (2013.01); *F41A 5/10* (2013.01); *F41A 9/64* (2013.01); *F41A 19/10* (2013.01); *F41A 25/12* (2013.01); *F41C 23/06* (2013.01)

(58) Field of Classification Search

CPC ..... F41A 3/26; F41A 3/54; F41A 3/56; F41A 3/78; F41A 3/80; F41A 3/82; F41A 25/10; F41A 25/12; F41A 25/14; F41C 3/00; F41C 23/06; F41C 27/22

See application file for complete search history.

(56) References Cited

U.S. PATENT DOCUMENTS

| | | | |
|---|---|---|---|
| 2,139,203 | A | 12/1938 | Petter |
| 2,522,192 | A | 9/1950 | Porter |

(Continued)

FOREIGN PATENT DOCUMENTS

| | | | |
|---|---|---|---|
| DE | 19951536 | C1 | 7/2001 |
| WO | 2009024309 | A2 | 2/2009 |

OTHER PUBLICATIONS

Definition of "Alignment". American Heritage® Dictionary of the English Language, Fifth Edition. Copyright © 2011 by Houghton Mifflin Harcourt Publishing Company, Published by Houghton Mifflin Harcourt Publishing Company.

*Primary Examiner* — Gabriel J. Klein

(74) *Attorney, Agent, or Firm* — GrayRobinson, P.A.; Michael J. Colitz, III

(57) ABSTRACT

Disclosed is a firearm configuration for a handgun. The firearm configuration is designed to reduce the recoil forces encountered by a user upon firing the weapon. It further includes a recoil plate that absorbs forces generated by the slide during firing. Recoil forces are reduced by lowering the firearm's center of mass and by aligning a recoiling mass with the user's arm and trigger finger. The firearm configuration further includes a locking block which prevents rotational and lateral movement of the barrel upon firing.

6 Claims, 16 Drawing Sheets

Related U.S. Application Data

9,644,909, which is a continuation-in-part of application No. 14/997,060, filed on Jan. 15, 2016, now Pat. No. 9,546,832, which is a continuation-in-part of application No. 14/948,716, filed on Nov. 23, 2015, now Pat. No. 9,551,542, which is a continuation of application No. 14/313,495, filed on Jun. 24, 2014, now Pat. No. 9,194,650, which is a continuation-in-part of application No. 13/617,953, filed on Sep. 14, 2012, now abandoned.

(51) Int. Cl.
*F41A 5/10* (2006.01)
*F41C 23/06* (2006.01)

(56) References Cited

U.S. PATENT DOCUMENTS

| | | | | |
|---|---|---|---|---|
| 2,846,925 | A | 8/1958 | Norman | |
| 3,027,673 | A | 4/1962 | Oliver | |
| 3,082,667 | A | 3/1963 | Ramseyer | |
| 3,365,829 | A | 1/1968 | Shockey | |
| 3,491,650 | A | 1/1970 | Rohr | |
| 4,031,808 | A | 6/1977 | Raville | |
| 4,176,584 | A | 12/1979 | Thomas, Jr. et al. | |
| 4,388,855 | A | 6/1983 | Sokolovsky | |
| 4,522,107 | A | 6/1985 | Woodcock et al. | |
| 4,569,270 | A | 2/1986 | Timari | |
| 4,579,037 | A * | 4/1986 | Gillum | F41A 3/62 42/72 |
| 4,715,140 | A | 12/1987 | Rosenwald | |
| 4,955,155 | A | 9/1990 | Jones | |
| 5,069,110 | A | 12/1991 | Menck | |
| 5,076,139 | A | 12/1991 | Hiett | |
| D328,632 | S | 8/1992 | Bigwood | |
| 5,675,106 | A | 10/1997 | Leiter | |
| 5,734,120 | A | 3/1998 | Besselink | |
| 5,815,972 | A | 10/1998 | Anderson | |
| 5,818,972 | A | 10/1998 | Girod et al. | |
| 6,129,000 | A | 10/2000 | Schmid | |
| 6,212,991 | B1 | 4/2001 | Frazier, III | |
| 6,530,306 | B1 | 3/2003 | LaFleur | |
| 6,742,297 | B2 | 6/2004 | Lakatos et al. | |
| 8,037,805 | B1 | 10/2011 | Neroni | |
| 8,132,352 | B2 | 3/2012 | Lippard | |
| 8,156,677 | B2 | 4/2012 | Glock | |
| 8,539,706 | B1 | 9/2013 | Vieweg et al. | |
| 9,897,403 | B2 * | 2/2018 | Kedairy | F41A 3/86 |
| 2006/0266209 | A1 * | 11/2006 | Grabowski | F41A 3/86 89/198 |
| 2009/0126559 | A1 | 5/2009 | Mantas | |
| 2010/0031812 | A1 | 2/2010 | Kerbrat et al. | |
| 2010/0077643 | A1 | 4/2010 | Kerbrat et al. | |
| 2014/0075799 | A1 | 3/2014 | Hangen | |
| 2016/0047613 | A1 * | 2/2016 | Hudson, III | F41A 3/86 42/14 |
| 2018/0164058 | A1 * | 6/2018 | Hudson, III | F41A 3/86 |

* cited by examiner

FIREARM CONFIGURATION FOR REDUCING RECOIL

CROSS REFERENCE TO RELATED APPLICATIONS

This application claims priority to and is a continuation-in-part of application Ser. No. 15/988,165 filed on May 24, 2018 and entitled "Fixed Barrel Firearm Configuration for Reducing Recoil," which is a continuation-in-part of application Ser. No. 15/485,626 filed on Apr. 12, 2017 and entitled "Fixed Barrel Firearm Configuration For Reducing Recoil," which is a continuation-in-part of application Ser. No. 15/095,415 filed Apr. 11, 2016, entitled "Firearm Configuration for Reducing Recoil", now U.S. Pat. No. 9,644,909, which itself is a continuation-in-part of application Ser. No. 14/997,060 filed Jan. 15, 2016, entitled "Firearm Configuration for Reducing Frame Battering," now U.S. Pat. No. 9,546,832, which itself is a continuation-in-part of application Ser. No. 14/948,716 filed Nov. 23, 2015, entitled "Firearm Configuration for Reducing Recoil," now U.S. Pat. No. 9,551,542, which itself is a continuation of application Ser. No. 14/313,495 filed Jun. 24, 2014, entitled "Firearm Configuration For Reducing Recoil," now U.S. Pat. No. 9,194,650, issued Nov. 24, 2015, which itself is a continuation-in-part of application Ser. No. 13/617,953 filed Sep. 14, 2012, entitled "Firearm Configuration for Reducing Recoil," now abandoned. The contents of all of these applications are fully incorporated herein for all purposes.

TECHNICAL FIELD

This disclosure relates to a firearm configuration. More specifically, the present invention relates to an open bolt firearm with a mechanism for reducing recoil, both perceived and actual.

BACKGROUND OF THE INVENTION

Handguns have grown increasingly more powerful over the years. As caliber size increases, so does the recoil of the firearm. Recoil is the rearward momentum generated by a firearm upon firing. Large caliber firearms generally create a substantial recoil impulse upon firing, which may cause the weapon to be forced upward due to an imbalance of forces. Unless properly adjusted for by the user, the recoil of a firearm may cause the user to fire inaccurately and miss the intended target. This is especially the case when firing in a fully automatic mode, as in a machine pistol.

This problem is a result of physics. The mass and velocity of a projectile must exert an equal and opposite reaction in the system behind it. This relationship is defined as "free recoil" in the firearm industry. Free recoil, in turn, results in muzzle rise. Muzzle rise is defined as the immediate, post-fire angular velocity of the firearm about its center of force. The center of force is determined by both the user's hand pressure across the grip and the handgun's own center of mass.

For the foregoing reasons, efforts have been made over the years to reduce the amount of recoil generated by a firearm. For instance, U.S. Pat. No. 6,742,297 to Lakatos discloses a firearm recoil reduction method. The method employs a spring, a trigger housing and a barrel. Additionally, U.S. Pat. No. 4,388,855 to Sokolovsky discloses a firearm pneumatic slide decelerator assembly. The assembly includes a recoil spring in proximity to a trigger housing. U.S. Pat. No. 5,069,110 to Menck discloses an impact buffering recoil mechanism. The mechanism includes a recoil spring in proximity to a trigger housing.

Furthermore, U.S. Pat. No. 2,139,203 to Petter discloses an automatic pistol with a rearward displacement that extracts and ejects the case of a fired cartridge. In the return movement, the upper cartridge is extracted from a magazine. Another firearm is disclosed by U.S. Pat. No. 2,846,925 to Norman. Norman discloses a firearm with a breech block operated disconnector. The moveable breech utilizes recoil to reload and cock the weapon. Finally, DE 19951536 to Radlinger discloses a hand gun with a counter-weight displaced in opposition to movement.

Although each of these inventions achieves its own individual objective, none of the background art relates to a mechanism for lessening recoil by lowering a firearm's center of mass. The firearm configuration described herein is aimed at overcoming these and other shortcomings noted in the background art.

SUMMARY OF THE INVENTION

The disclosed system has several important advantages. For example, the disclosed firearm configuration reduces the recoil encountered by the user.

A further possible advantage is that recoil forces are reduced by lowering the firearm's center of reciprocating mass. A manufacturer may further reduce recoil by overweighting the reciprocating mass in line with the hand past what is necessary for basic structural integrity.

Still yet another possible advantage of the present system is to lower the axis along which recoil forces are generated to thereby lessen the associated torque.

Another advantage of the present system is to improve the user's capacity for accuracy by reducing recoil. Higher recoil forces disrupt most firearm users' concentration and inflame something akin to the "fight or flight" instinct, so less recoil equals less psychological disruption, which in turn promotes the users' capacity for accurate fire. This increase in accuracy via reduced recoil is most pronounced in the application of this system to a machine pistol format, as such weapons are generally less controllable due to their light weight, comparatively meager grip surface area, and high rate of fire in full automatic mode.

Another advantage is realized by utilizing a firearm configuration that allows the manufacturer to integrate the recoil spring guide rod with the frame, resulting in fewer parts and lowering manufacturing costs. This also has the beneficial result of simplified disassembly procedures for the end user and increased reliability of the weapon.

A further advantage is that the firearm configuration of the present disclosure decreases overall weapon height with no appreciable reduction in magazine capacity as compared to known designs. Alternatively, the present configuration can result in a weapon of equal height to known designs, but with an increased magazine capacity.

A further advantage of the present system is that it allows a user to execute quicker follow-up shots, as the recoil forces impeding faster shots will be reduced.

The firearm configuration of the present disclosure also reduces the recoil of a given cartridge, which allows more powerful ammunition to be utilized with approximately the same recoil as a conventional configuration. The use of more powerful ammunition, in turn, allows for a flatter bullet trajectory and thus increased effective range of a handgun. Also, the ability to use more powerful ammunition with the same recoil allows for the use of larger-caliber armor-penetrating bullets, resulting in increased lethality and effectiveness on the battlefield.

Another advantage is that the system provides for a lower barrel axis when combined with a rotating barrel locking mechanism, further reducing recoil.

The advantages of the present system may be further maximized by using any or all of the following additional design elements: use of a sliding trigger assembly, use of a striker firing mechanism, or use of external or "slide in frame" guide rails.

A further advantage of the present system is that it may be configured to eliminate the snag or catch point located at the front corner of the trigger guard, thereby making the action of holstering or un-holstering the weapon easier.

Another advantage of the present system is realized by providing an open bolt type firearm with a mechanism for reducing recoil.

Yet another advantage of the present system is realized by providing a firearm that lends itself to fully automatic firing while at the same time providing a means for reducing associated recoil.

Still yet another advantage is provided by a firearm that is well ventilated, avoiding problems associated with overheating while still redirecting and abating associated recoil forces.

Various embodiments of the invention may have none, some, or all of these advantages. Other technical advantages of the present invention will be readily apparent to one skilled in the art.

BRIEF DESCRIPTION OF THE DRAWINGS

For a more complete understanding of the present disclosure and its advantages, reference is now made to the following descriptions, taken in conjunction with the accompanying drawings, in which.

Similar reference numerals refer to similar parts throughout the several views of the drawings.

DETAILED DESCRIPTION OF THE DRAWINGS

The present disclosure relates to a firearm configuration for a handgun. The firearm configuration is designed to reduce the recoil forces encountered by a user upon firing the weapon. Recoil forces are reduced by lowering the firearm's center of mass and by aligning a recoil plate that absorbs forces generated by the slide during firing and recoil mass which aligns with the user's arm and trigger finger. The various details of the present disclosure, and the manner in which they interrelate, will be described in greater detail hereinafter.

Figure 1:
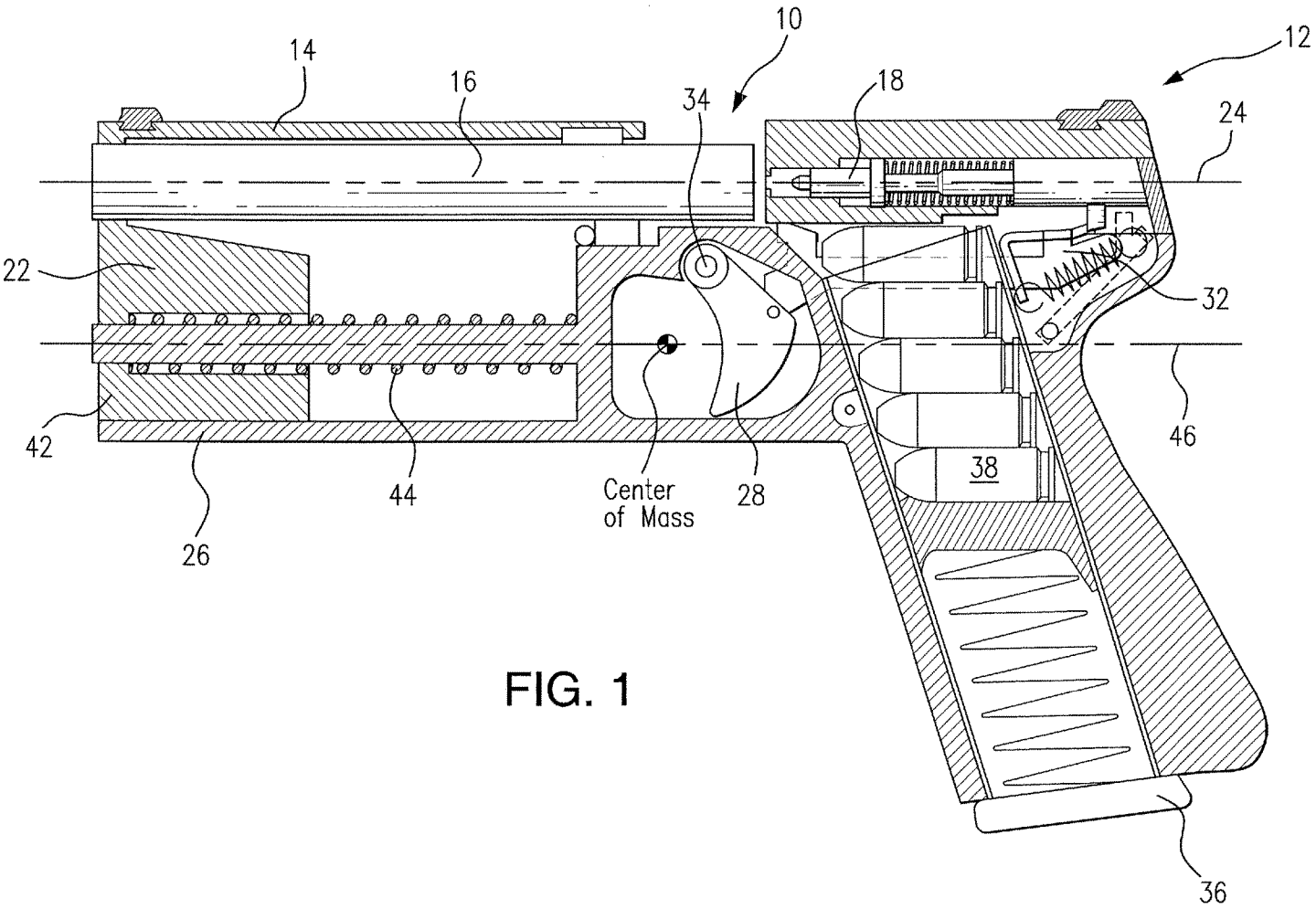
FIG. 1 is a cross sectional view of the firearm configuration prior to firing.
Figure 2:
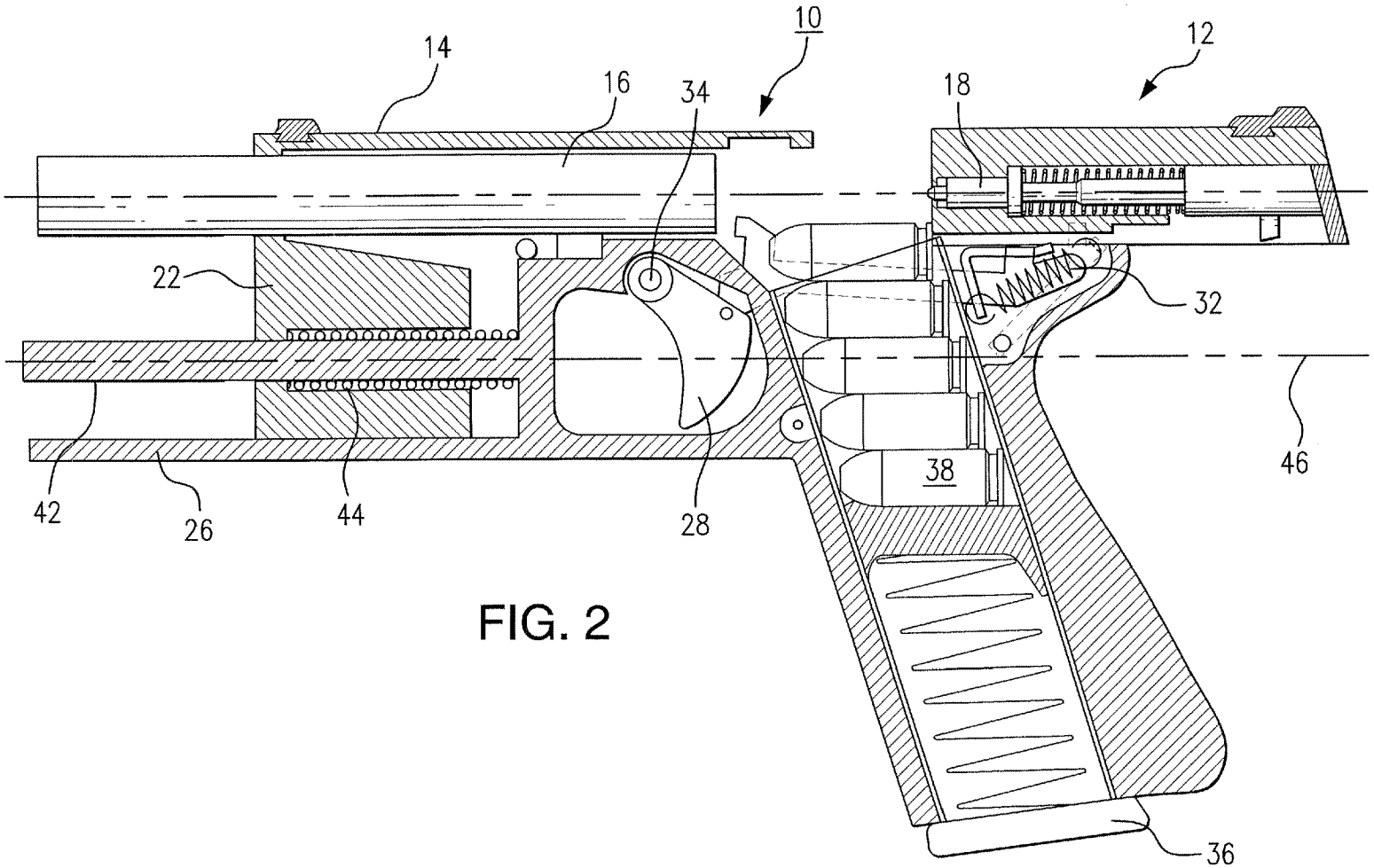
FIG. 2 is a cross sectional view of the firearm configuration after firing.

With reference now to FIGS. 1 and 2, the firearm configuration (10) of the present disclosure is disclosed. As noted, configuration (10) assists in reducing recoil forces encountered by the user of an associated firearm (12). The configuration (10) includes an upper housing (14). Upper housing (14) is alternatively referenced as a "slide," to describe its movement relative to lower housing (26). Upper housing (14) houses a barrel (16) and a firing assembly (18). The barrel (16) and firing assembly (18) are of a conventional construction. The specific trigger (28) and trigger assembly (32) depicted are of the type found in the Glock® series of handguns. Upper housing (14) further includes a recoil mass (22) with an opening. In one possible embodiment, recoil mass (22) is tapered along its upper edge, with a thicker forward end and a narrowed rearward end. The recoil mass (22), however, need not be tapered. As noted in the figures, barrel (16) and firing assembly (18) are positioned in axial alignment with one another and are positioned along a first axis (24). First axis (24) is defined prior to the weapon being fired. The firing assembly (18) can take the form of a conventional striker firing assembly or a conventional hammer firing assembly. The use of other conventional firing assemblies is also within the scope of the present disclosure. One suitable firing assembly is disclosed in U.S. Pat. No. 8,156,677 entitled "Assemblies and Firearms Incorporating such Assemblies," which issued to Gaston Glock on Apr. 17, 2012. The contents of this issued patent are fully incorporated herein for all purposes.

Configuration (10) further includes a lower housing (26) that is slidably interconnected to the upper housing (14). A trigger (28) and trigger assembly (32) are positioned within the lower housing (26). The disclosed trigger (28) is a pivoting trigger, but sliding triggers can also be used in connection with the present invention. The depicted trigger (28) and trigger assembly (32) are of the type found in the Glock® series of handguns, as well as U.S. Pat. No. 8,156,677, and are of a standard and well known construction. In accordance with the invention, trigger (28) pivots about a second axis (34). Second axis (34) is positioned below, and is perpendicular to, the first axis (24). The trigger assembly (32) is interconnected to the striker assembly (18). As is known in the art, ammunition (38) is delivered upwardly from the magazine (36) under a spring force into the upper housing (14). Individual cartridges to be fired are delivered between the barrel (16) and the firing assembly (18). Trigger assembly (32) is used to selectively actuate the striker assembly (18) and fire the firearm (12). The relationship between trigger assembly (32) and striker assembly (18) will be appreciated to those of ordinary skill in the art. The exact mechanism employed does not form part of the present invention and can be similar to that utilized by the type found in the Glock® series of handguns.

Lower housing (26) further includes a guide rod (42) and recoil spring (44) that extend through the opening in the recoil mass (22). Recoil spring (44) has an end seated within recoil mass (22). Guide rod (42) is positioned along a third axis (46). The third axis (46) is positioned below the second axis (34). Guide rod (42) is integral with the lower housing (26).

In accordance with the present disclosure, when a user fires firearm (12), the upper housing (14) slides back with respect to the lower housing (26). This action, in turn, causes the recoil mass (22) to slide along the guide rod (42) to compress the recoil spring (44). The recoil generated by firearm (12) is greatly reduced by the position and movement of the recoil mass (22). More specifically, the axis of the recoil spring (44)—i.e. the third axis (46)—is parallel to and below the first axis (24), which is an axis drawn down the centerline of the barrel (16) prior to the firing of the weapon, and upon which the bullet exits the barrel. In this regard, the first and third axes (24) and (46) remain parallel to each other at all times during firing. As a result, the linear momentum generated by ammunition (38) leaving barrel (16) is completely countered by the linear momentum of the recoil mass (22) moving towards trigger (28). In other words, ammunition (38) leaving barrel (16) travels on a vector that is 180 degrees from the vector of the recoil mass (22). The positioning of recoil mass (22) below barrel (16) and striker assembly (18) also effectively lowers the center of mass of the overall firearm (12). In the preferred embodiment, the center of mass is in alignment with the recoil spring (44) (see FIG. 1). It should be noted that the exact center of mass may change as ammunition (38) is depleted. Nonetheless, it is preferred to keep the center of mass as closely aligned with recoil spring (44) as possible. By lowering the center of mass, there is no lever arm created between the trigger finger or arm and the center of mass. Such a lever arm would multiply any recoil forces and produce unwanted torque.

Recoil is further reduced by positioning the axis of trigger (28)—i.e. the second axis (34)—in close proximity (i.e. approximately 1 inch or less) to the first axis (24). This ensures that the recoil mass (22) is in alignment with the user's trigger finger and/or arm upon firing. Computer modeling of the claimed invention demonstrates that a recoil mass of approximately 0.38 lbs., located approximately 3.1 inches forward of, and approximately 0.5 inches beneath, the center of force greatly reduced the associated muzzle rise. Specifically, the modeling showed that about 22% more free recoil was absorbed as compared to a conventional firearm. Likewise, muzzle rise was reduced by approximately 59%.

Guide Rod Portions

Figure 3:
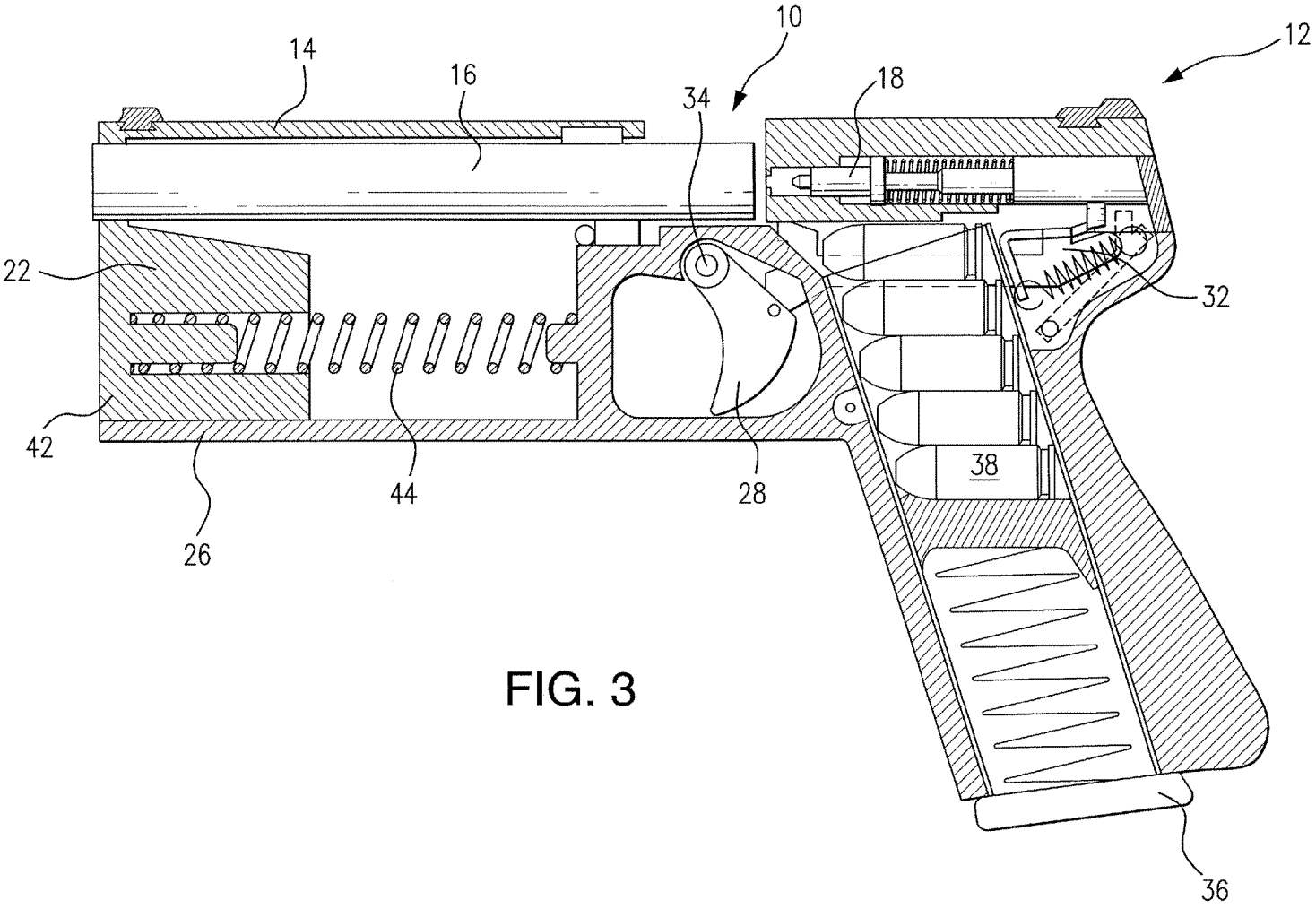
FIG. 3 is a cross sectional view of an alternative embodiment of the firearm configuration prior to firing.
Figure 4:
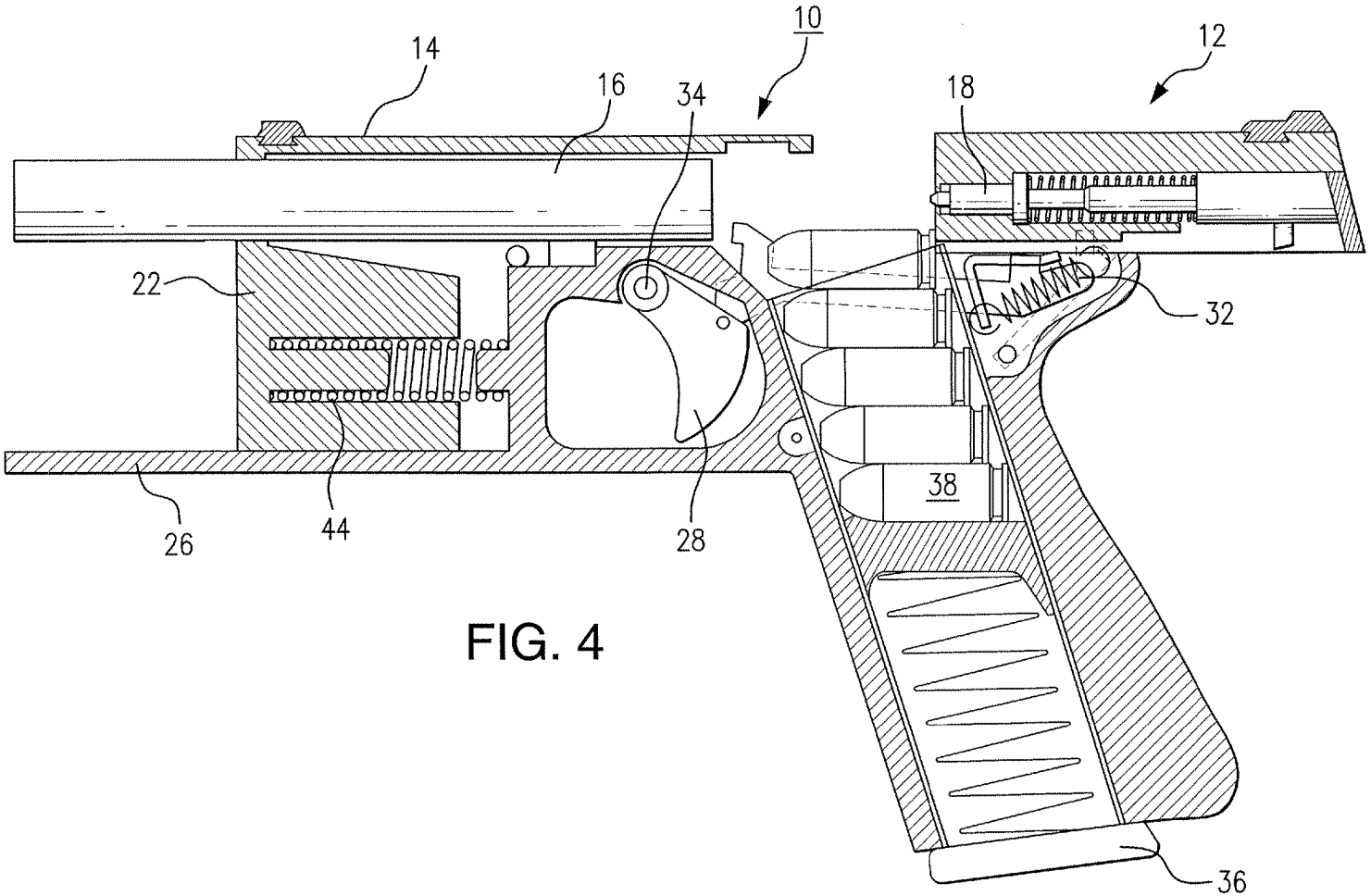
FIG. 4 is a cross sectional view of an alternative embodiment of the firearm configuration after firing.

A second embodiment of the firearm (12) is illustrated in FIGS. 3 and 4. This embodiment is the same in most respects as the firearm (12) depicted in FIGS. 1 and 2. However, in the second embodiment, the guide rod (42) does not extend through the recoil mass (22). Instead, the guide rod (42) is replaced by a first guide rod portion (42*a*) that extends from within the recoil mass (22). Additionally, a second guide rod portion (42*b*) extends from the area in front of the trigger. Guide rods portions (42*a* and 42*b*) are preferably in alignment. Recoil mass (22) is adapted for linear movement within second housing (26) and in alignment with trigger (28). Thus, in the second embodiment, the guide rod (42) does not fully extend within recoil spring (44). Instead, first guide rod portion (42*a*) extends a short distance within the first end of spring (44) and the second guide rod portion (42*b*) extends a short distance within the second end of spring (44). This embodiment is possible because it has been discovered that spring (44) does not need to be supported along its entire length to be effective. This reduces the overall weight of firearm (12) without any reduction in the effectiveness of the recoil mass (22). It should be noted that second guide rod portion (42*b*) merely fixes the position of the recoil spring adjacent trigger. Accordingly, other configurations, such as an appropriately sized cavity can be used to fix the position of spring (44). Still yet other retaining mechanisms, in lieu of guide rod portions (42*a* and 42*b*) can be used. It is also possible to eliminate the use of any retaining mechanisms.

At its most basic, this reconfiguration takes the guide rod (42) from being a passive part in the recoil cycle to an active part of the recoil cycle, making the resultant weapon more efficient with regard to the use of existing weight.

The reconfigured guide rod (42*a* and 42*b*) also increases the mass of the recoil mass (22), which can be relocated lower in front of the trigger. This allows for a greater reduction in recoil and/or muzzle rise. The weapon has further reduced recoil over our previous work, and further lowers the firearm's center of reciprocating mass. As such, it is an example of overweighting the reciprocating mass in line with the hand past what is necessary for basic structural integrity. Also, though the axis on which the spring is guided is not further lowered, the overall axis along which recoil forces are transmitted to the user is further lowered with this addition.

The use of the reconfigured rod (42*a* and 42*b*) also reduces the total part count by integrating the guide rod with the slide (as opposed to the frame), thus allowing for decreased production cost and increased reliability. The reconfigured guide rod (42*a* and 42*b*) still allows for similar disassembly in comparison with current designs, and thus does not require additional training. The reconfigured guide rod (42*a* and 42*b*) further reduces recoil, which allows for more rapid follow-up shots and for the use of more powerful ammunition.

Increasing the mass present in the slide internally allows for a weapon with the same exterior slide dimensions to fire more powerful ammunition; alternatively, it allows for a reduction in the exterior slide dimensions of the weapon while still allowing for an identical level of ammunition power.

In the case of an existing pistol using a steel guide rod, this relocation would shift a portion of the total weapon weight from the frame assembly to the slide, essentially allowing for a pistol of equal weight to fire more powerful ammunition in comparison to said existing pistol. This comparison is between a modified and an unmodified pistol both using a half-length guide rod—as such, you could take a pistol with an existing full-length guide rod and modify it by relocating the guide rod (substituting a half-length one) to the slide, thereby creating a pistol both lighter than the unmodified version and yet still able to use more powerful ammunition. Such a substitution is once again assuming all guide rods in both pistols are composed of steel.

The embodiments presented herein may also be improved by overweighting a lower section (48) of the recoil mass (22) or reducing the weight of the upper housing (14). Preferably, the lower section of the recoil mass (22) is the lower half of the recoil mass (22) but may be any amount of the recoil mass (22) that will allow for the center of mass to drop an appreciable amount. Similarly, a reduced weight portion of the upper housing (14) would comprise part of the upper half of same upper housing (14), but may be any amount of the upper housing (14) that will allow for the center of mass to drop an appreciable amount. The upper housing (14), or a portion of such, may be made of a lighter material such as aluminum, titanium, carbon fiber composite, or a similarly durable polymer, whereas the lower section (48) may be made of a heavier material such as tungsten, bismuth, or depleted uranium to further lower the center of mass. The lower section (48) and upper section (50) of the recoil mass (22) may be connected by friction fitting, threads, pinning, dovetailing, adhesive, or any other method for attachment whether known or yet to be discovered. The same methods of attachment apply to the joining of any reduced weight portion of the upper housing (14) with the remainder of the same upper housing (14). Alternatively, the lower section (48) of the recoil mass (22) may be overweighted using the same material as the upper section (50) while remaining the same material as the upper section (50). The result of these modifications is a reduction in the amount of muzzle rise and associated recoil.

Recoil Plate

Figure 5:
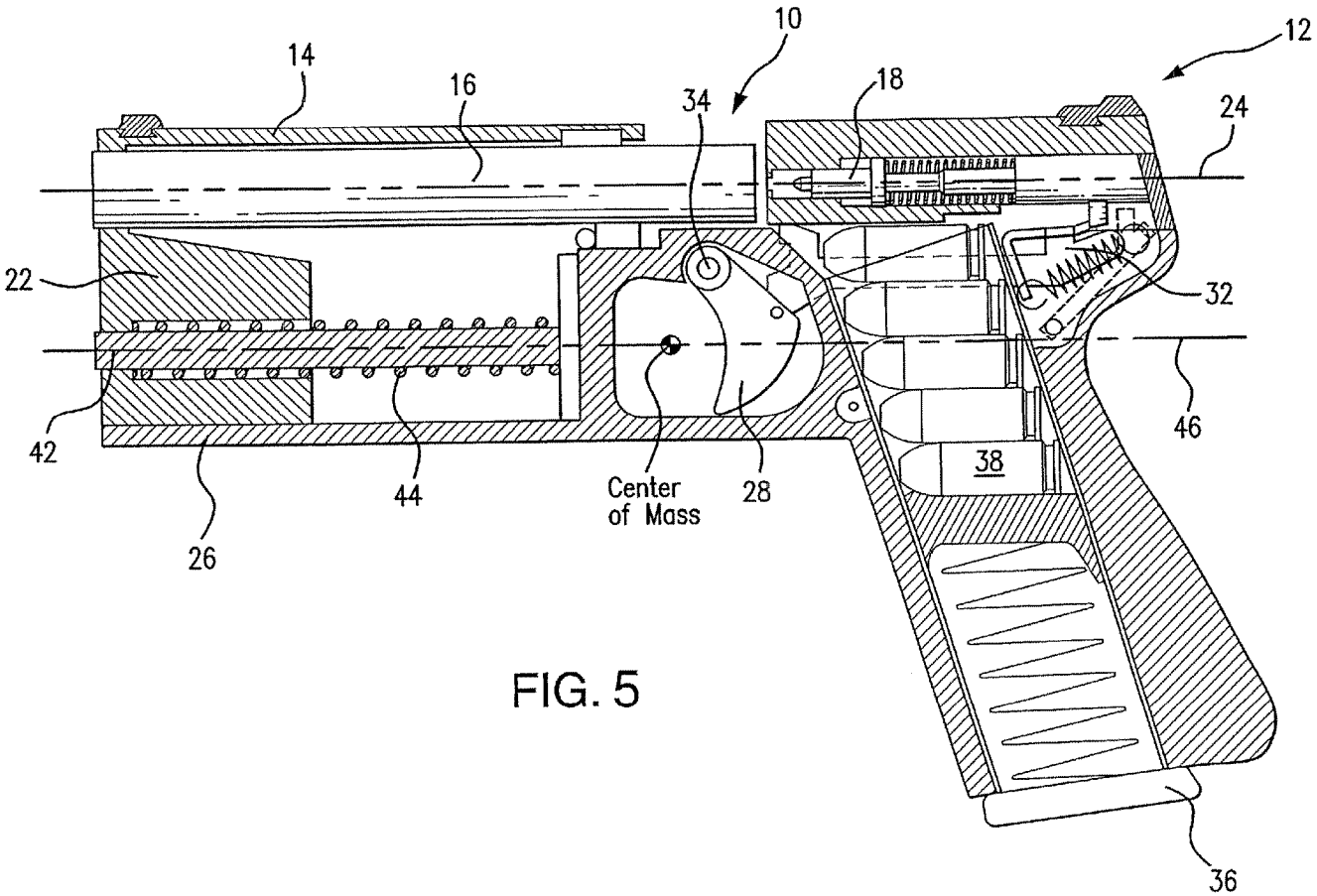
FIG. 5 is a cross sectional view of an alternative embodiment of the firearm configuration prior to firing with the recoil plate.

The embodiment of FIG. 5 further includes a recoil plate (52). Recoil plate (52) is positioned in the area immediately forward of the trigger housing. Recoil plate (52) is preferably constructed from a high strength material, such as steel or titanium, or equivalent alloys or composite materials. This allows recoil plate (52) to absorb impact forces generated by recoil mass (22) during firing. Specifically, during firing, recoil mass (22) travels rearwardly to impact recoil plate (52). Recoil plate (52) function as a reinforcement means to absorb recoil forces and prevent damage to weaker components of the firearm (10). Recoil pate (52) can be formed integrally with the remainder of the firearm (10) or can be attached via suitable fasteners, such as rivets, welds, pins, or other fasteners. Recoil plate (52) can be integrally formed as part of guide rod (42). The end of recoil spring (44) preferably abuts the face of recoil plate (52). As more fully described hereinafter, alternative embodiments of recoil plate (52) may include an angled component (54) that extends over the top of the trigger housing (FIG. 2). Recoil plate (52) may also include upper rails (56) upon which the upper slide (14) travels (FIG. 5).

Recoil plate (52) is preferably composed of high-strength material and is inserted into the comparatively lower-strength frame in the area under impact from the slide during recoil. The recoil plate (52) increases the durability of the frame not only through its advantage in material composition but also by further increasing the surface area available to the frame for transmitting the force imparted by the slide (14). This increase in surface area may include the normally wasted space directly behind the guide rod (42), but also by extending the sides and/or top and/or bottom of the recoil plate further into the frame. This may be assisted by an angled component (54) The latter not only helps to seat the recoil plate in the frame but also gives the frame additional surface area to absorb the slide impact beyond merely the surface area of the rear of the slide.

As noted, recoil plate (52) optionally includes an integrated guide rod (42). Integration of the guide rod (42) with the recoil plate (52) (which itself may be permanently attached to the rest of the frame) results in a decreased parts count, lower manufacturing costs, simplified disassembly procedure, and increased weapon reliability.

Figure 6:
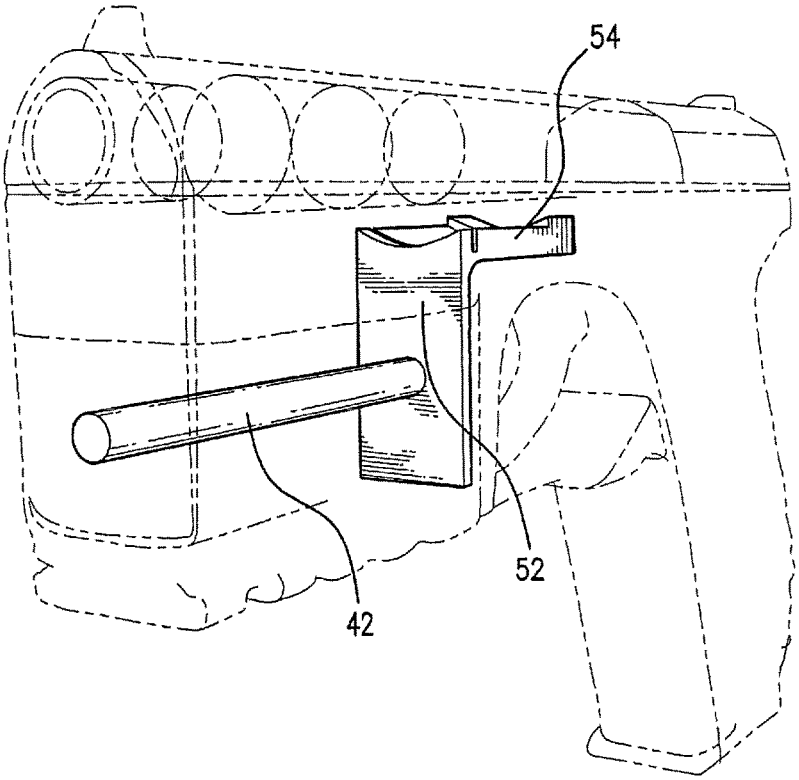
FIG. 6 is a detailed view of the recoil plate of the present disclosure.
Figure 7:
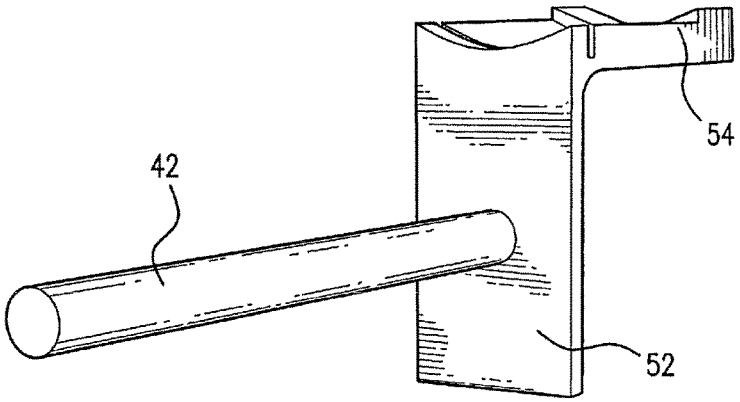
FIG. 7 is a perspective view of the recoil plate of the present disclosure.

FIGS. 6 and 7 also show a refined recoil plate (52) with an angled component (54) that extends back over the trigger guard area in the frame. This allows the cam to interact with the track on a rotating barrel or other mechanism that similarly facilitates barrel locking and unlocking. This would also reduce parts count and manufacturing cost while increasing weapon reliability, as the cam must be made from high-strength material to interact with the steel (or other high strength material) barrel.

It is also possible to include an accommodation to reinforce the area of the frame housing a barrel retention device upon the upper surface of angled component (54). Barrel retention devices interact with the bottom of the barrel when the slide and barrel are fully forward under spring pressure to retain both parts on the frame. The area of the frame around and interacting with the barrel retention device is a very high-stress area also, prone to cracking and other wear. By fortifying this area with high-strength material, frame wear is reduced and weapon reliability increased without increasing weapon parts count.

Figure 8:
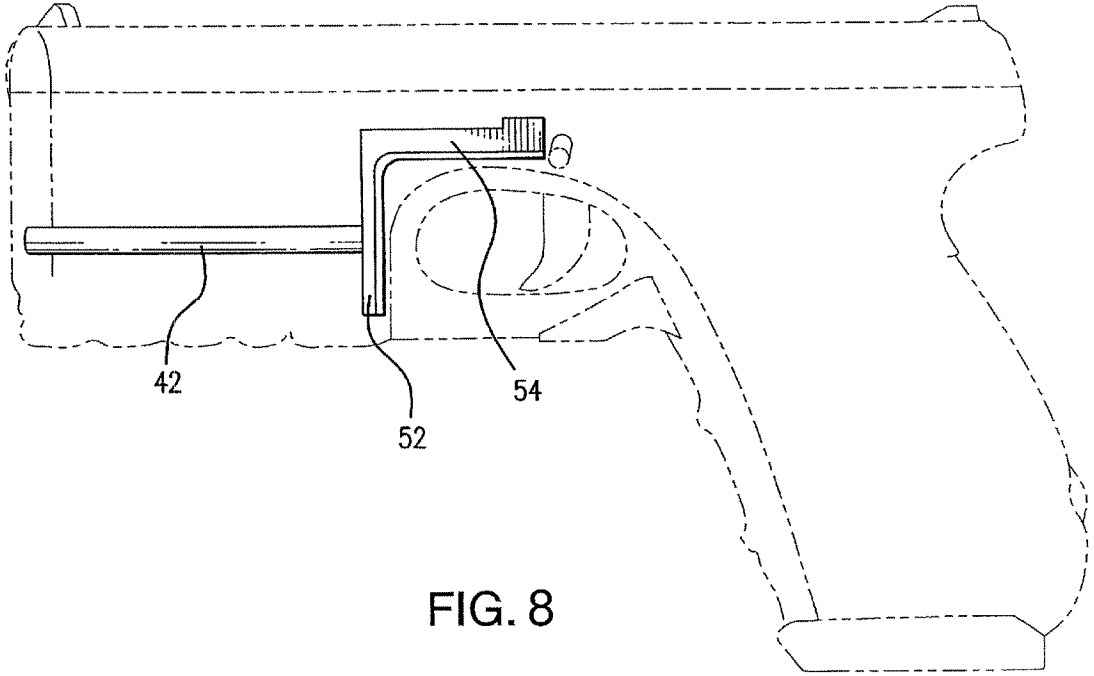
FIG. 8 is a view of the recoil plate in place within the firearm.
Figure 9:
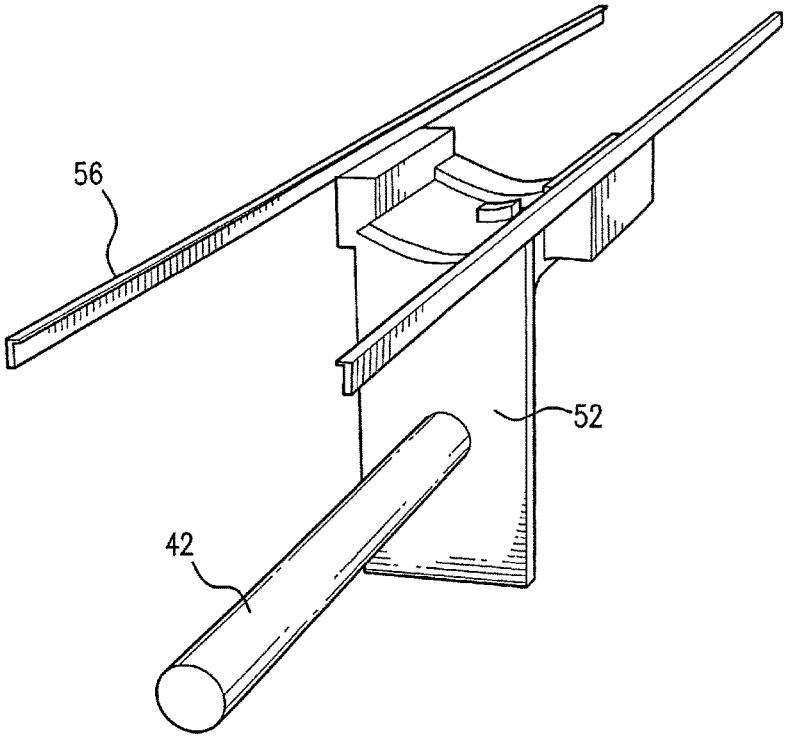
FIG. 9 is an alternative view of the recoil plate.

FIGS. 8 and 9 illustrates yet another embodiment. In this embodiment, the recoil plate (52) is fitted with a pair of upper rails (56). These rails (56) integrate onto the recoil plate the frame rails which mate with the rails on the slide (14), upon which the slide reciprocates during the recoil stroke. Such an integration would lead to lower manufacturing costs due to a lower number of parts being manufactured for insertion into the frame. It also enhances the modularity of the design, as a removable insert of this type would allow for frame rail replacement without having to replace the entirety of the frame.

Locking Block and Lug

Figure 10:
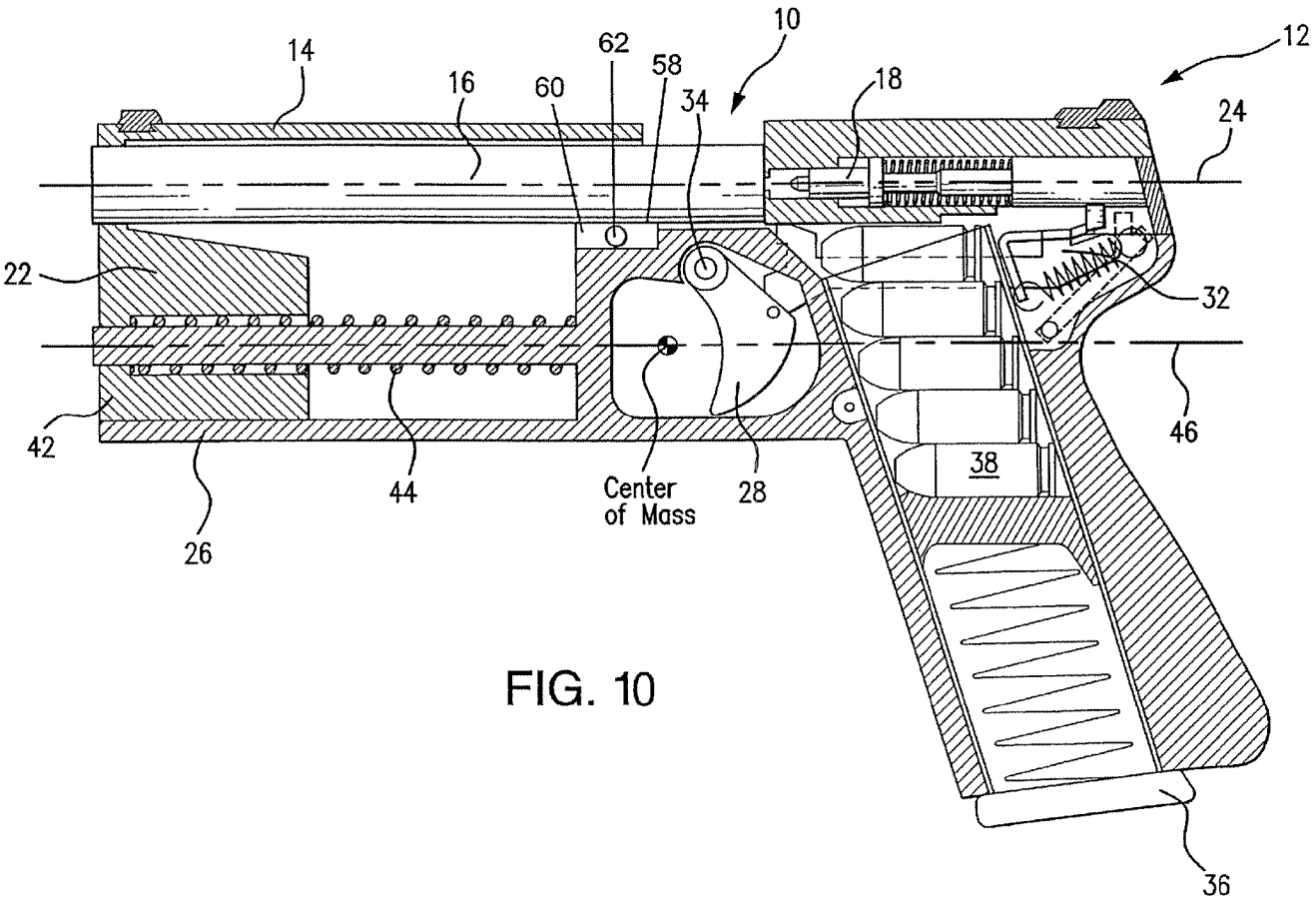
FIG. 10 is a cross sectional view of an alternative embodiment of the firearm configuration prior to firing.
Figure 11:
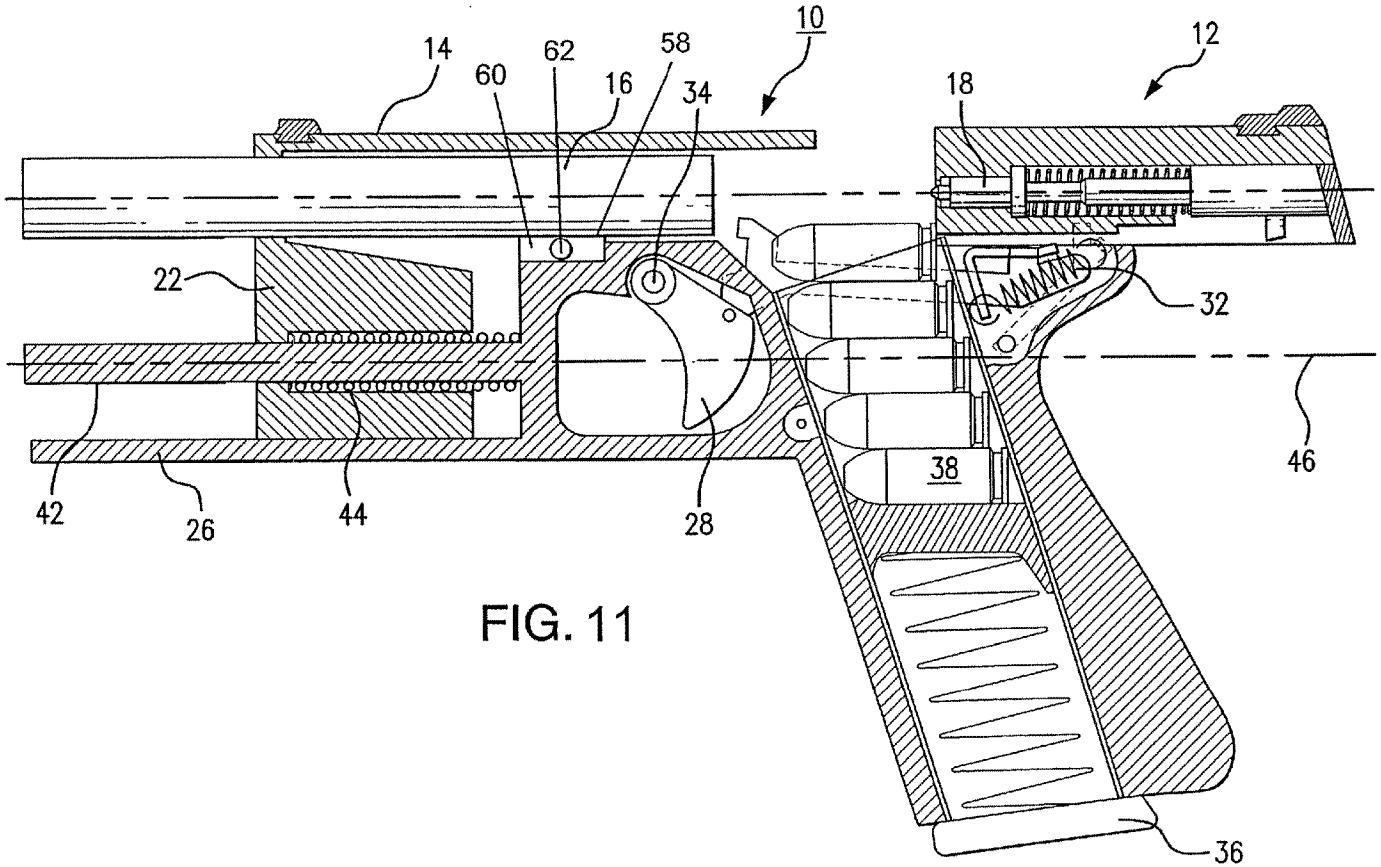
FIG. 11 is a cross sectional view of an alternative embodiment of the firearm configuration after firing.

Another embodiment of the firearm (12) is illustrated in FIGS. 10 and 11. This embodiment is the same in most respects as the firearm (12) depicted in FIGS. 1 and 2. However, in this embodiment, a locking assembly (58) comprising a locking block (60) and locking lug (62) are present so as to prevent any rotational or lateral movement of the barrel (on any axis). The locking lug (62) is preferably a pin but may be any mechanical or other way now known or otherwise to be discovered for preventing movement of the barrel, for instance chemical bonding, adhesives, welding, or the like. Likewise, the firearm (12) could have a large frame projection that the barrel (16) is press-fit or threaded into, or the barrel (16) can be fixed through the use of a rotating lever or spring-loaded sliding catch. Otherwise, this embodiment is the same in most respects as the firearm (12) depicted in FIGS. 1 and 2.

Multiple Guide Rods

Figure 12:
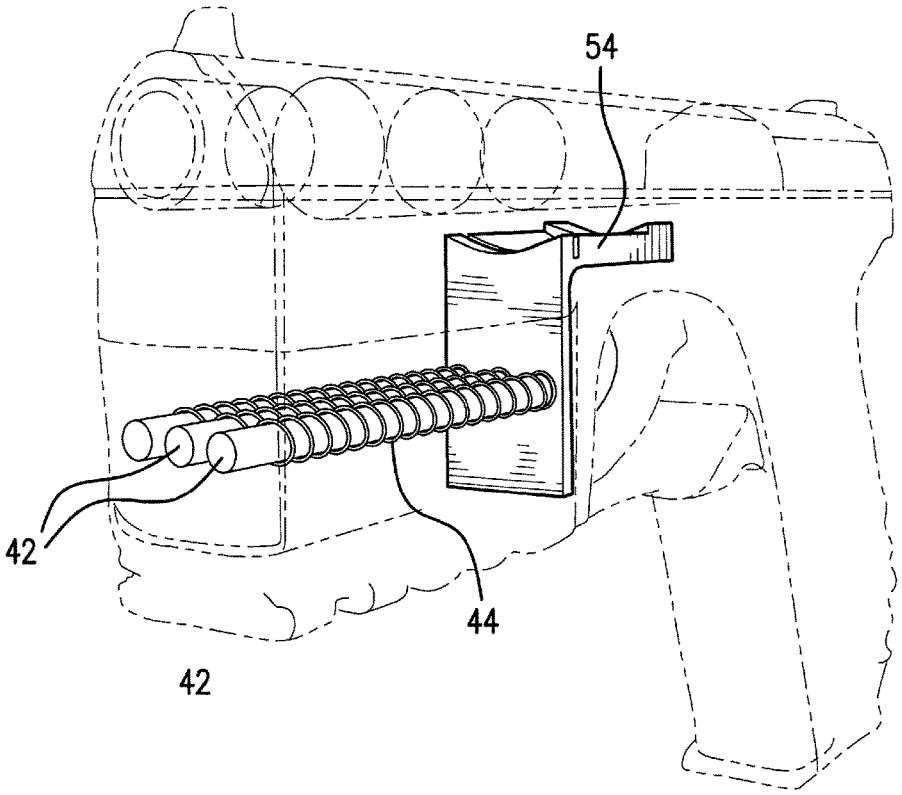
FIG. 12 is a perspective view of an alternative embodiment employing multiple guide rods.

A further embodiment of the present invention is disclosed in FIG. 12. This embodiment is the same is all respects as the embodiments described above; however, instead of a single guide rod (42), a series of three guide rods (42) are utilized. In the depicted embodiment, three guide rods (42) are oriented to be parallel to one another and each is fitted with a recoil spring (44). This embodiment is disclosed in conjunction with a recoil plate (52). Nonetheless, the use of such a recoil plate (52) is optional. In the absence of a recoil plate (52), guide rods (42) would extend from the trigger guard of the lower housing (26). This embodiment would operate in a fashion similar to the primary embodiment, namely the recoil mass (22) (FIG. 13) would include a series of three apertures to accept the three guide rods (42) and associated recoil springs (44). Individual recoil springs (44) are positioned over each of the guide rods (42) and extend between an aperture in the recoil mass (22) and the backing plate (52) or trigger guard. Upon firing, the recoil mass (22) would slide along the three guide rods (42) and against the force of the associated springs (44). This would have the effect of counterbalancing any recoil forces in the firearm.

Figure 13:
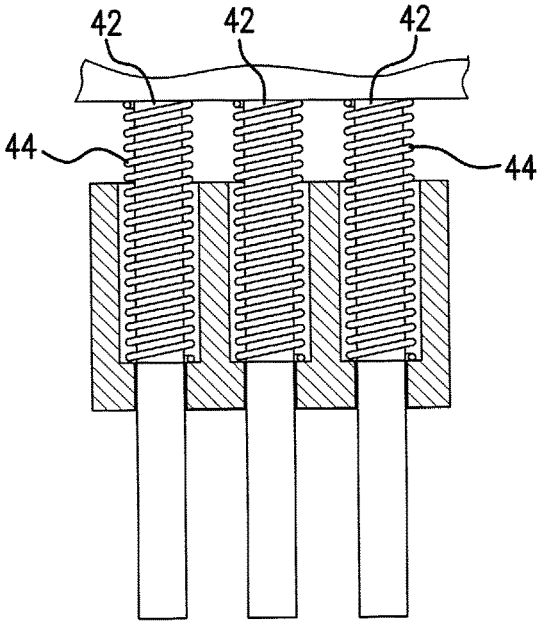
FIG. 13 is a plan view of the multiple guide rods that can be used in the firearm.
Figure 14:
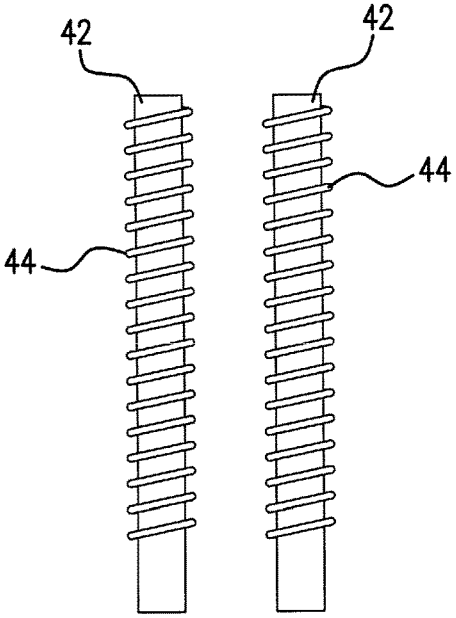
FIG. 14 is a plan view of the multiple guide rods that can be used with the firearm.

FIG. 13 is a top plan view of the three guide rods (42) and their associated recoil springs (44). This view shows the recoil mass (22) into which the guide rods (42) and springs (44) are inserted. Although the alternate embodiment has been depicted as three guide rods, other numbers of guide rods can also be used. For instance as illustrated in FIG. 14, two guide rods with associated recoil springs (44) could be used in lieu of three guide rods.

Open Bolt Firearm

Figure 15:
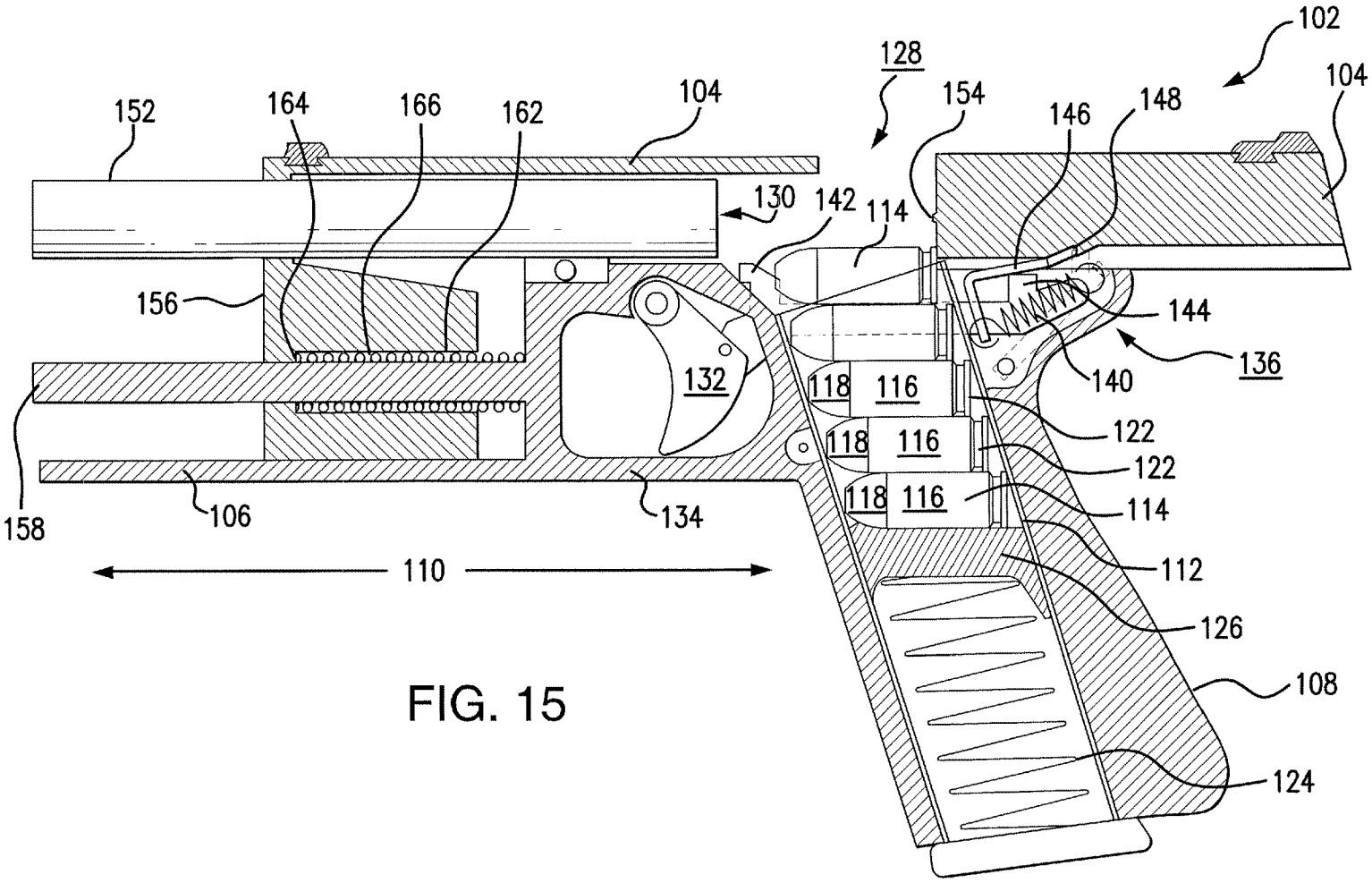
FIG. 15 is a cross sectional view of an embodiment of the firearm employing an open bolt construction.
Figure 16:
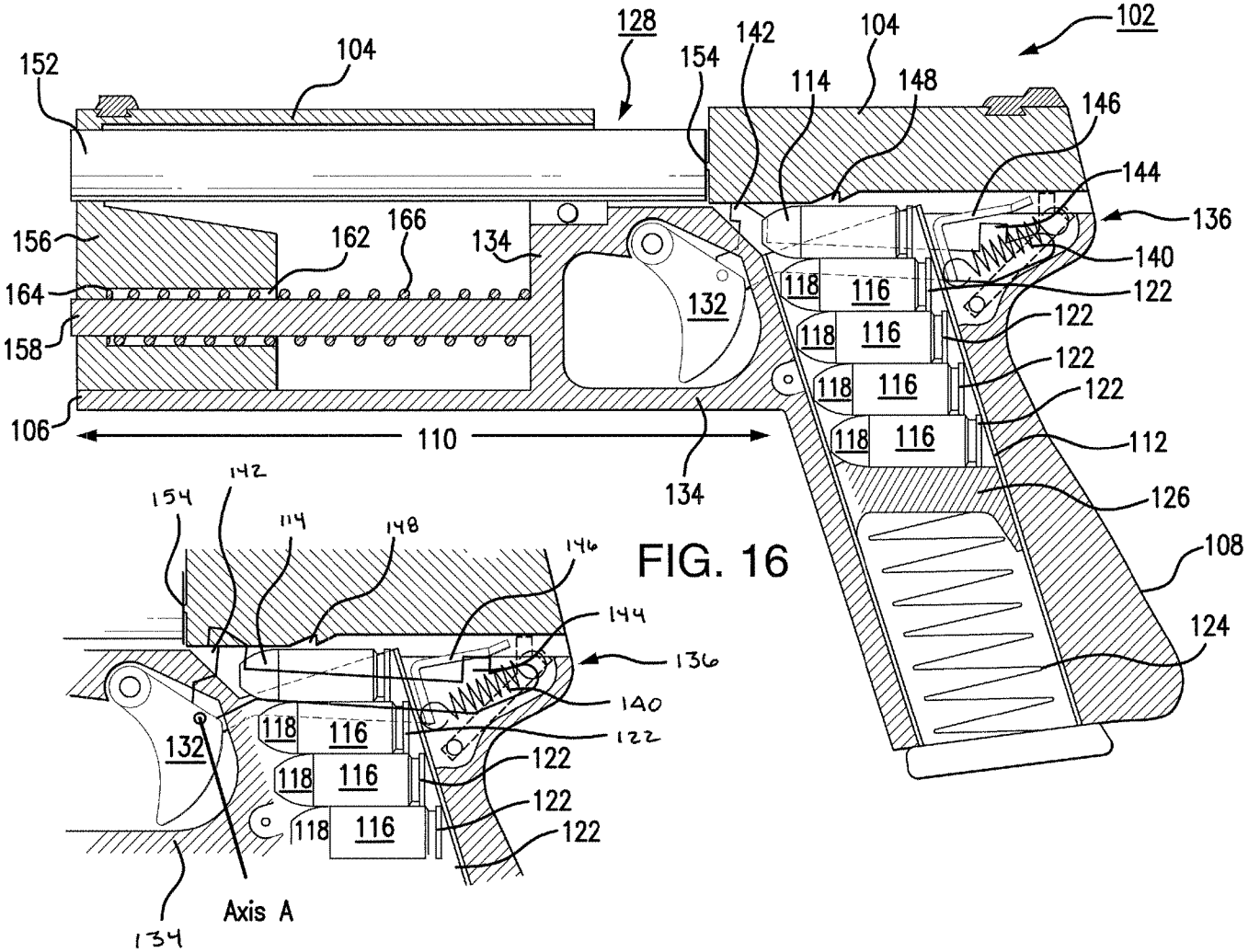
FIG. 16 is a cross sectional view of an embodiment of the firearm employing an open bolt construction.

A further alternative embodiment of the present firearm is shown in FIGS. 15 and 16. The disclosed firearm (102) is adapted to be fired with the user's trigger finger and generally includes forward and rearward ends. It is likewise configured with a mass for reducing the amount of recoil felt by the user during firing.

As illustrated in FIGS. 15 and 16, upper and lower housings (104, 106) are included that are slidably interconnected to one another along internal slides, rails, or other similar structures. FIG. 15 illustrates the firearm (102) prior to firing. FIG. 16 shows the firearm (102) after it has been fired. Notably, in the open bolt configuration, the firearm (102) starts with the upper housing (104) slid rearwardly with respect to the lower housing (106). Upon firing, the upper housing (104) slides forwardly to the forward most end of firearm (102). As also illustrated, the rear extent of the lower housing (106) includes both a grip (108) and an internal magazine (112). The magazine (112) houses a number of rounds (114) in a stacked configuration as is known, with each round including a casing (116), a projectile (118), and a primer (122). A spring (124) and a lower shelf or magazine follower (126) are included in the magazine (112) to selectively feed each round into a chamber (130). Chamber (130) is located within the rear extent of the barrel (152). The firearm employs an open bolt configuration in that an ejection port (128) remains opened both before and after firing. A number of rounds (114) can be stored in a single magazine, with the magazine being inserted or removed from the lower end of grip (108).

Also disclosed is a trigger (132) and trigger housing (134) that are located at the intermediate extent of firearm (102). By way of non-limiting example, trigger (132) may include a curved or an arcuate shape for comfortably receiving the trigger finger of the user. However, a flat trigger face may also be employed. As illustrated, trigger (132) is interconnected to a trigger mechanism (136) that of, among other components, a trigger bar (142) with a sear (146). The configuration placement, and function of these trigger components will be well understood by one of ordinary skill in the art. As illustrated, the rearward extent of the upper housing (104) includes a notch (148) for selectively engaging or disengaging the sear (146). Prior to firing, the upper housing (104) is slid rearwardly with respect to the lower housing (106) and against the force of recoil spring (166). A trigger spring 140 is also included for providing tension to trigger mechanism (136). Upper housing (104) is maintained in this position by positioning sear (146) firmly within notch (148).

Thereafter, when the user pulls trigger (132), the sear (146) is released and the upper housing (104) slides forwardly with respect to the lower housing (106). This action also causes a front face (or breechface) of the upper housing (104) to push a round (114) to be fed upwardly into chamber (130) of barrel (152) for firing. Barrel (152) is positioned within the forward extent of the upper housing (104). The round (114) is fired via a fixed firing pin (154) as described herein after. As is known in the art, rifling may be included on the internal surface of barrel (152). Fixed firing pin (154) is positioned upon the rearward extent of the upper housing (104), a surface also known as the breechface. One of the advantages of the open bolt configuration is that it limits the number of parts for the firing mechanism. This static, fixed firing pin (154) is adapted to impact the primer (122) of a chambered round (114) to initiate the firing sequence.

Next, the recoil reducing mechanism is described. This mechanism incudes a recoil mass (156) that is integrally formed as part of the forward extent of the upper housing (104). In other words, the upper housing (104) and recoil mass (156) are formed from the same material and move in unison. Recoil mass (156) is slidably positioned along the guide rod (158). The internal aperture (162) includes a step (164) at the forward end. In this regard, internal aperture (162) is sized to receive rod (158). A spring is preferably positioned between this internal step (164) formed and the adjacent surface of the trigger housing (134). This configuration allows the spring (166) to bias the recoil mass (156) to the forward end of the firearm (102).

Figure 17:
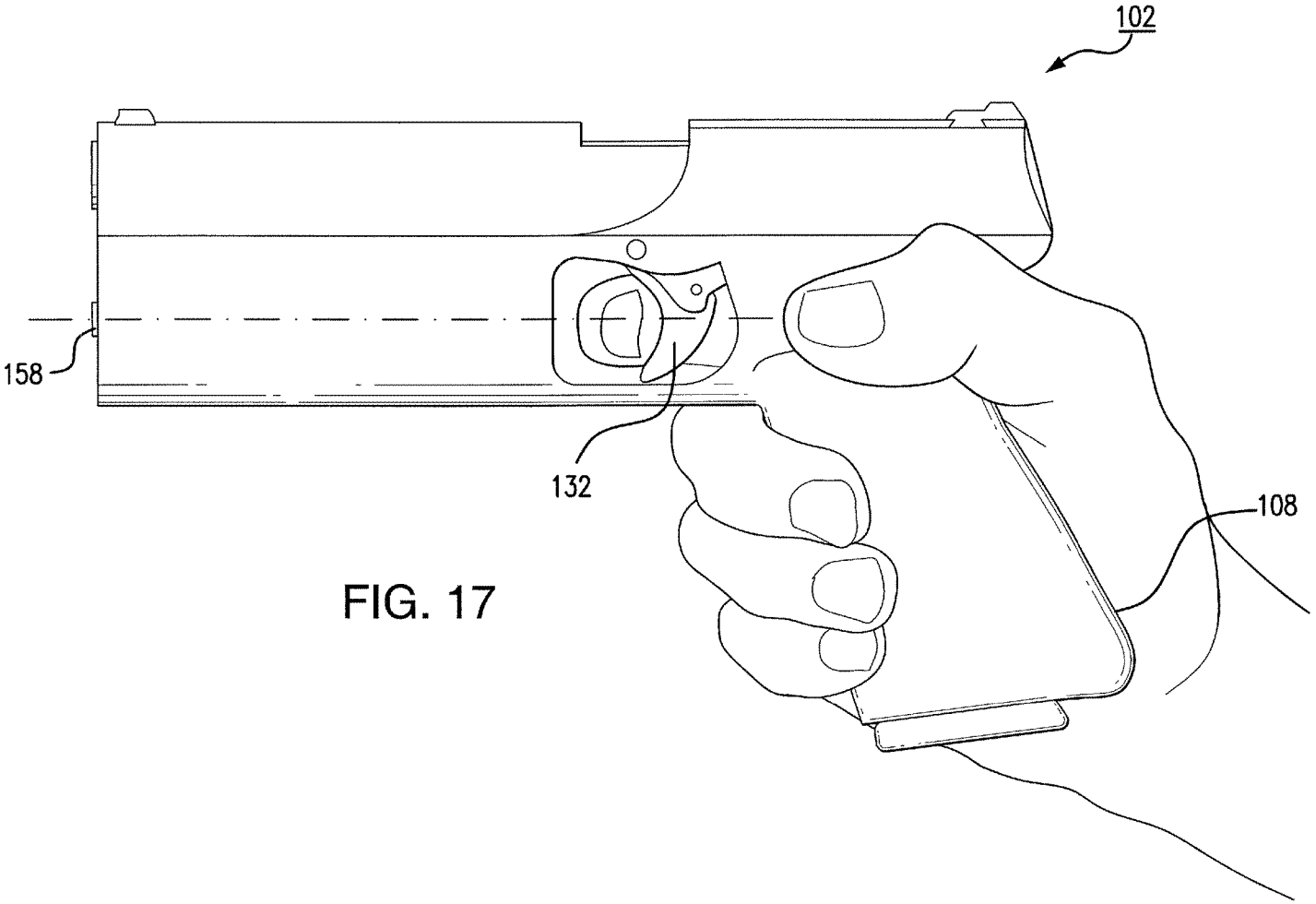
FIG. 17 is a side elevational view of the firearm illustrating the user's trigger finger in line with the guide rod, recoil mass, and recoil spring.

In use, after the user pulls the trigger (132), the upper housing (104) slides forwardly to both chamber a round and allow the firing pin (154) to engage the primer (122). This results in the projectile (118) being propelled out through the end of barrel (152). As this occurs, recoil mass (156) initially slides to the forward end of the firearm (102). The firing cycle is completed as the recoil mass (156) and upper housing (104) return to their rearward position as indicated in FIG. 15. Recoil forces are reduced as the recoil mass (156) slides rearwardly against the tension of the spring (166). FIG. 17 is a side elevational view of the firearm illustrating the user's trigger finger in line with the guide rod, recoil mass, and recoil spring.

In open bolt systems, the slide or bolt of the firearm is held to the rear until it is fired. Upon pulling the trigger, the bolt moves forward to both feed a round into the barrel's chamber and to cause a preferably fixed firing pin to strike the primer of the round. This eliminates the need for a mobile firing pin and associated firing pin spring. The resulting energy of the shot causes the bolt to then move backwards to eject the spent cartridge casing completing the cycle. Such an open bolt weapon format results in a weapon that is optimized for fully automatic fire. The fixed firing pin can be integrated into the slide or pinned into the slide or otherwise fastened. This results in greater reliability due a to lower number of parts and the deletion of all components associated with a separate firing pin. This also results in a lower cost of manufacture and simplified disassembly procedures.

Open bolt systems also provide a weapon with improved cooling when the weapon is being fired at a high rate as both the barrel and action have a greater access to air flow through the chamber and the ejection port. FIG. 15 discloses the firearm in a configuration that is ready to be fired with the slide or bolt retracted. Once the firing mechanism releases the slide or bolt, the slide or bolt moves forward to both strip a cartridge off the top of the magazine for chambering, and fires the cartridge via detonating the primer through the impact of the fixed firing pin in the breechface of the slide or bolt. In this regard, the integrated firing pin may have a protrusion for impacting the cartridge primer. FIG. 16 shows that weapon immediately after it has been fired. Here, the spent cartridge casing has been omitted from the chamber of the barrel for clarity. As illustrated, the firing mechanism has released the slide or bolt forward and the fired cartridge has been stripped from the magazine. The recoil impulse from the fired round will move the slide or bolt to the rear once more to reset the firing mechanism for the next firing cycle. Other than implementing this open bolt format, the details of the recoil reducing mechanism are the same as that illustrated in FIGS. 1-14.

Although this disclosure has been described in terms of certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure.

What is claimed is:

1. An open bolt firearm comprising:

upper and lower housings slidably interconnected to one another, each housing having a forward extent and a rearward extent;

a grip forming part of the rearward extent of the lower housing, a barrel with a chamber, an open ejection port formed within the upper housing;

a trigger and trigger housing positioned between the forward and rearward extent of the lower housing;

a barrel positioned within the forward extent of the upper housing;

a firing pin positioned upon a forward surface of the rearward extent of the upper housing;

a guide rod positioned within the forward extent of the lower housing, the guide rod being substantially aligned with a user's trigger finger when the grip is held by the user in a read-to-fire position;

a recoil mass being slidably positioned along the guide rod, a spring positioned between the recoil mass and the trigger housing;

whereby when the user pulls the trigger a round is chambered and the firing pin moves forward to engage a primer of the round and fire the firearm, and whereby recoil forces are reduced as the recoil mass slides toward the rearward end of the firearm and against the tension of the spring.

2. The open bolt firearm as described in claim 1 further comprising a trigger bar with a sear manipulated by the trigger, the sear selectively engaging and disengaging the rearward extent of the upper housing, whereby pulling the trigger disengages the sear to permit the upper housing to slide to the forward end of the firearm.

3. The open bolt firearm as described in claim 1 further comprising a barrel with a chamber, and an open ejection port formed within the upper housing;

a magazine formed within the grip for delivering rounds to be fired into the chamber.

4. The open bolt firearm as described in claim 1 wherein the firing pin is fixed.

5. The open bolt firearm as described in claim 1 wherein the recoil mass includes an internal aperture and wherein one end of the spring is seated upon a rear surface of the recoil mass.

6. An open bolt firearm adapted to be fired by the trigger finger of a user, the firearm having forward and rearward ends, the firearm configured to reduce the amount of recoil felt by the user during firing, the firearm comprising:

upper and lower housings slidably interconnected to one another, each housing having a forward extent and a rearward extent, the upper housing sliding to the forward end of the firearm upon firing;

a grip and magazine forming part of the rearward extent of the lower housing, the magazine housing a number of rounds, each round including a primer, a barrel with a chamber, an open ejection port formed within the upper housing, the magazine delivering rounds to be fired into the chamber;

a trigger and trigger housing positioned between the forward and rearward extent of the lower housing, the trigger manipulating to a trigger bar with a sear, the sear selectively engaging and disengaging the rearward extent of the upper housing, whereby pulling the trigger disengages the sear to permit the upper housing to slide forward, whereby a round is chambered and firearm is fired;

a barrel positioned within the forward extent of the upper housing, the barrel adapted to receive a round in its chamber;

a fixed firing pin positioned upon a forward surface of the rearward extent of the upper housing, the fixed firing pin adapted to impact the primer of a chambered round as the firearm is fired;

a guide rod positioned within the forward extent of the lower housing, the guide rod being substantially aligned with the user's trigger finger when the grip is held by the user in a read-to-fire position;

a recoil mass formed as part of the forward extent of the upper housing, the recoil mass being slidably positioned along the guide rod, a spring positioned between the recoil mass and the trigger housing, the spring biasing the recoil mass to the forward end of the firearm;

whereby when the user pulls the trigger a round is chambered and the fixed firing pins moves forward to engage the primer and fire the firearm, and whereby recoil forces are reduced as the recoil mass slides toward the rearward end of the firearm and against the tension of the spring.

* * * * *